US007530428B2

(12) United States Patent
Feist et al.

(10) Patent No.: US 7,530,428 B2
(45) Date of Patent: May 12, 2009

(54) EXHAUST DEFLECTOR FOR A MUFFLER

(75) Inventors: Jeffrey P. Feist, Pewaukee, WI (US); Elliot Matel, Milwaukee, WI (US); Matthew J. Nagel, Hartford, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 11/760,028

(22) Filed: Jun. 8, 2007

(65) Prior Publication Data

US 2008/0035421 A1 Feb. 14, 2008

Related U.S. Application Data

(63) Continuation of application No. 11/451,026, filed on Jun. 12, 2006.

(51) Int. Cl.

| | |
|---|---|
| ***F01N 1/10*** | (2006.01) |
| ***F01N 1/24*** | (2006.01) |
| ***F01N 3/06*** | (2006.01) |
| *F01N 1/00* | (2006.01) |
| *F01N 3/02* | (2006.01) |

(52) U.S. Cl. ..... 181/264; 181/256; 181/231

(58) Field of Classification Search ..... 181/264, 181/256, 230, 231, 252

See application file for complete search history.

(56) References Cited

U.S. PATENT DOCUMENTS

| | | | | | |
|---|---|---|---|---|---|
| 3,115,209 | A | * | 12/1963 | Bembinster | 181/243 |
| 3,196,977 | A | * | 7/1965 | Sanders | 181/256 |
| 3,380,553 | A | * | 4/1968 | Gibel | 181/230 |
| 3,561,561 | A | * | 2/1971 | Trainor | 181/267 |
| 3,677,364 | A | * | 7/1972 | Pawlina | 181/269 |
| 3,688,868 | A | * | 9/1972 | Gibel et al. | 181/230 |
| 3,757,892 | A | * | 9/1973 | Raudman, Jr. | 181/256 |
| 3,838,977 | A | * | 10/1974 | Warren | 422/179 |
| 3,863,733 | A | * | 2/1975 | Raudman et al. | 181/252 |
| 3,880,245 | A | * | 4/1975 | Anderson, Jr. | 173/219 |
| 4,033,428 | A | * | 7/1977 | Wennerstrom | 181/230 |
| 4,045,157 | A | * | 8/1977 | Peterson | 431/114 |
| 4,113,051 | A | | 9/1978 | Moller | |

(Continued)

FOREIGN PATENT DOCUMENTS

DE 3243631 A1 * 5/1984

(Continued)

OTHER PUBLICATIONS

Exhaust Deflector with fiberglass made by Enerpower SRL of Monza, Italy, at least as early as Feb. 1, 2006.

*Primary Examiner*—Edgardo San Martin
(74) *Attorney, Agent, or Firm*—Michael Best & Friedrich LLP

(57) ABSTRACT

An exhaust deflector is attachable to a muffler. The exhaust deflector includes a single-piece housing having a flange that defines an inlet aperture, an outlet wall that defines an outlet aperture, and an intermediate wall that interconnects the flange and the outlet wall. A mesh is in contact with the flange and is positioned to cover the inlet aperture. A perforated member is sandwiched between the mesh and the intermediate wall such that the perforated member and the intermediate wall cooperate to define a space. A low-density material is disposed within the space.

22 Claims, 6 Drawing Sheets

U.S. PATENT DOCUMENTS

| | | | | | |
|---|---|---|---|---|---|
| 4,135,602 | A | * | 1/1979 | Clark | 181/230 |
| 4,205,732 | A | * | 6/1980 | Auerbach et al. | 181/230 |
| 4,219,100 | A | * | 8/1980 | Wyse | 181/230 |
| 4,286,976 | A | * | 9/1981 | Eriksson | 96/387 |
| 4,316,523 | A | * | 2/1982 | Boretti | 181/226 |
| 4,324,314 | A | * | 4/1982 | Beach et al. | 181/230 |
| 4,424,883 | A | * | 1/1984 | Musiani | 181/258 |
| 5,166,479 | A | * | 11/1992 | Gras et al. | 181/256 |
| 5,177,962 | A | * | 1/1993 | Hall et al. | 60/311 |
| 5,627,351 | A | | 5/1997 | Okuma et al. | |
| 5,722,237 | A | * | 3/1998 | Iida et al. | 60/302 |
| 5,969,299 | A | | 10/1999 | Yamaguchi et al. | |
| 6,109,387 | A | | 8/2000 | Boretti | |
| 6,470,998 | B1 | | 10/2002 | White | |
| 6,540,046 | B1 | * | 4/2003 | Schuhmacher et al. | 181/231 |
| 6,968,922 | B2 | | 11/2005 | Kawamata et al. | |
| 7,185,678 | B1 | * | 3/2007 | Stell et al. | 138/41 |
| 2003/0136607 | A1 | | 7/2003 | Kawamata et al. | |
| 2005/0150716 | A1 | | 7/2005 | Nasuno et al. | |
| 2008/0099277 | A1 | * | 5/2008 | Liu et al. | 181/230 |

FOREIGN PATENT DOCUMENTS

| | | | | |
|---|---|---|---|---|
| EP | 1160424 | | | 5/2001 |
| GB | 2056563 | A | * | 3/1981 |

* cited by examiner

EXHAUST DEFLECTOR FOR A MUFFLER

RELATED APPLICATION DATA

The present application is a continuation-in-part of U.S. patent application Ser. No. 11/451,026 filed Jun. 12, 2006, and entitled "Exhaust Deflector for a Muffler," the entire contents of which are fully incorporated herein by reference.

BACKGROUND

The present invention relates to an exhaust deflector for a muffler. More particularly, the invention relates to an exhaust deflector for a small engine that reduces the engine noise.

Engines generally include a muffler that receives exhaust gas from the engine and redirects the flow of exhaust gas to reduce the noise of the engine. For example, many muffler designs include multiple passages and changes in flow direction that change the acoustic impedance (i.e., the velocity and/or the pressure) of the gas. Changes in the acoustic impedance are intended to create a mismatch that generally reduces the noise produced by the gas.

However, given the limited space on some small engines, it is possible that the space available for a muffler is not adequate to provide the level of noise attenuation desired.

SUMMARY

In one construction, the invention provides an exhaust deflector attachable to a muffler. The exhaust deflector includes a single-piece housing having a flange that defines an inlet aperture, an outlet wall that defines an outlet aperture, and an intermediate wall that interconnects the flange and the outlet wall. A mesh is in contact with the flange and is positioned to cover the inlet aperture. A perforated member is sandwiched between the mesh and the intermediate wall such that the perforated member and the intermediate wall cooperate to define a space. A low-density material is disposed within the space.

In another construction, the invention provides an exhaust deflector configured to be coupled to a muffler. The exhaust deflector includes a housing having a flange configured to attach to the muffler, and an outer wall that extends from the flange and defines an inlet aperture. A mesh is in contact with the flange and cooperates with the housing to at least partially define a space.

In yet another construction, the invention provides an exhaust deflector configured to be coupled to a muffler. The exhaust deflector includes a housing having a flange configured to attach to the muffler, and an outer wall that extends from the flange and defines an interior, an inlet aperture, and an outlet aperture. The inlet aperture and the outlet aperture are configured to define an upstream direction. A perforated member is disposed substantially within the interior. The perforated member cooperates with the housing to at least partially define a space. A mesh is coupled to the housing and is positioned upstream of the perforated member.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
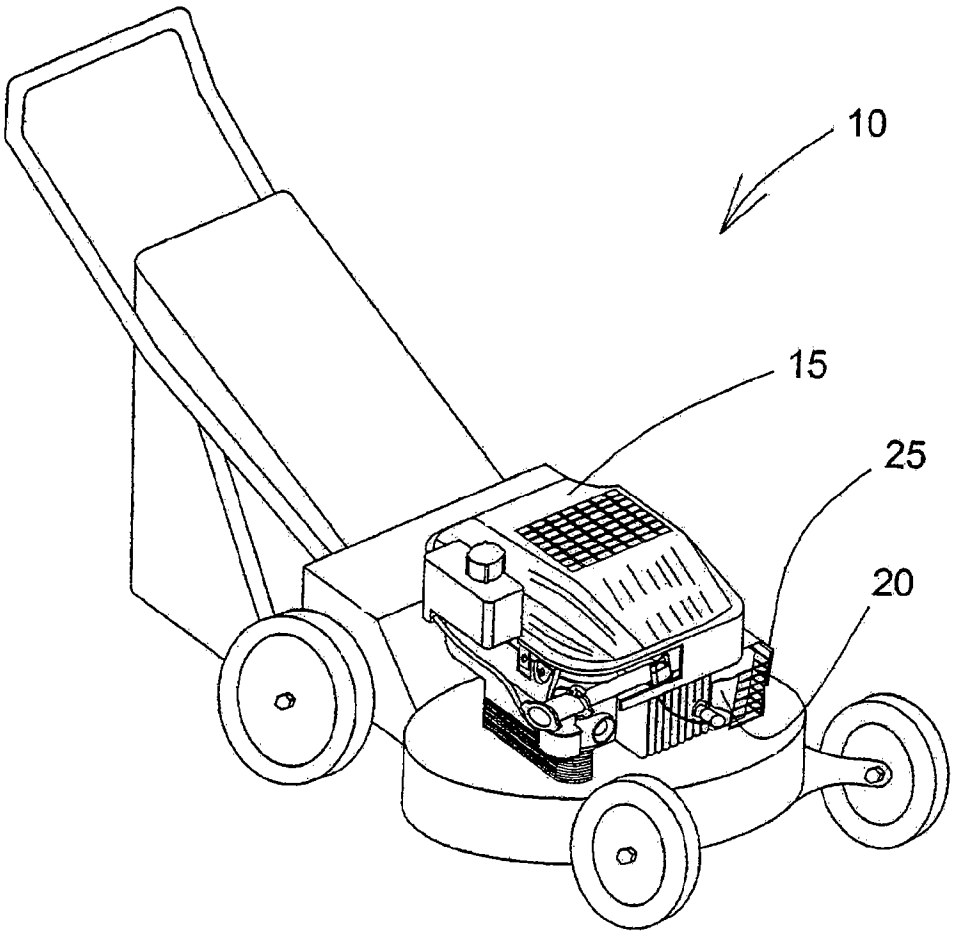
FIG. 1 is a perspective view of a lawn mower including an engine having a muffler.

FIG. 1 illustrates a lawn mower 10 that includes a small engine 15. The engine 15 includes a piston that reciprocates within a cylinder in response to combustion of an air-fuel mixture within a combustion chamber. The reciprocation of the piston produces a corresponding rotation of a crankshaft which in turn rotates a power take off to perform work.

Before proceeding, it should be noted that the term "small engine" as used herein generally refers to an internal combustion engine that includes one or two cylinders. The engine can be arranged with a horizontal or a vertical crankshaft as may be required. While the invention discussed herein is particularly suited for use with small engines, one of ordinary skill in the art will realize that it could be applied to larger engines (i.e., three or more cylinders) as well as other engine designs (e.g., rotary engine, radial engine, diesel engines, combustion turbines, and the like). In fact, the invention could be applied to virtually any flow stream in which a reduction in noise is desired. As such, the invention should not be limited to the small engine application described herein.

With continued reference to FIG. 1, the engine 15 includes a muffler 20 that receives a flow of exhaust gas from the cylinder, quiets the flow of exhaust gas, and discharges the exhaust gas to the atmosphere. In the illustrated construction, a guard 25 is positioned over the muffler 20 to reduce the likelihood of contact with the muffler 20 during engine operation.

Figure 2:
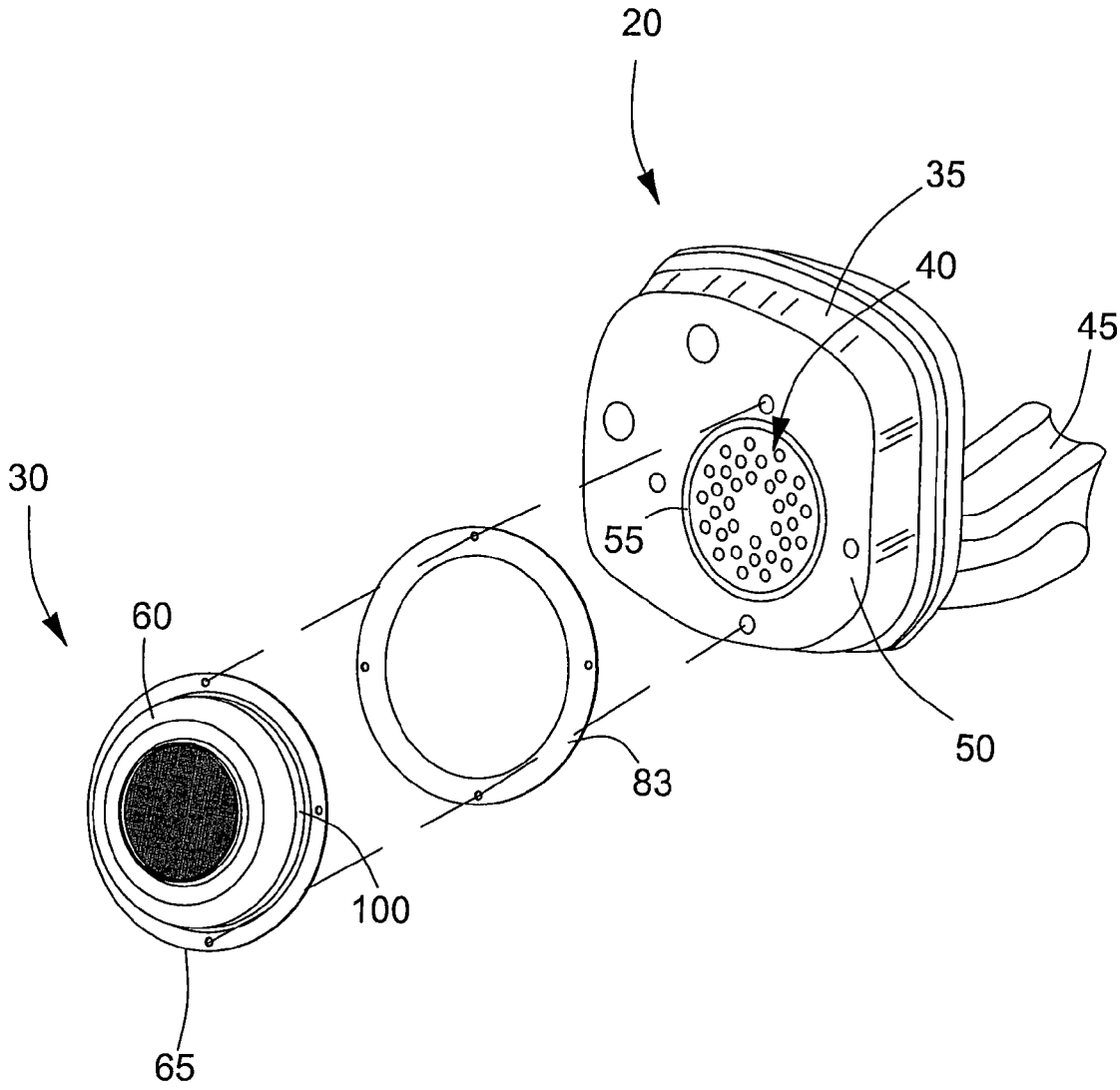
FIG. 2 is a perspective view of the muffler of FIG. 1 including an exhaust deflector.

FIG. 2 illustrates the muffler 20 of FIG. 1 including an exhaust deflector 30. The muffler 20 includes a housing 35 or casing that defines a muffler chamber, an outlet aperture 40, and an inlet 45 such as an inlet aperture or an inlet tube. The inlet 45 is in fluid communication with the cylinder or cylinders to receive the flow of exhaust gas and direct that flow to the muffler chamber. The muffler chamber includes one or more passages (not shown) that redirect the flow to change the acoustic impedance and the noise produced by the engine 15.

The housing 35 defines a surface 50 having the outlet aperture 40. The surface 50 has a muffler flange 55 that receives the exhaust deflector 30 such that the outlet aperture 40 is in fluid communication with the exhaust deflector 30. In the illustrated muffler, the outlet aperture 40 includes a plurality of small apertures arranged on a plurality of concentric circles. The arrangement of the outlet aperture is utilized by the exhaust deflector to enhance the sound reduction as will be discussed with regard to FIGS. 3-9.

It should be noted that FIG. 2 illustrates one possible muffler 20 suited for use with the exhaust deflector 30. In the illustrated construction, the muffler housing 35 defines the muffler flange 55 to which the exhaust deflector 30 attaches. In other constructions, a tube or exhaust pipe may extend from the housing 35 and receive the exhaust deflector 30. In addition, other inlet arrangements, muffler chamber arrangements, and housing arrangements are also possible and will not affect the function of the exhaust deflector 30.

FIGS. 3-6 illustrate the exhaust deflector 30 of FIG. 2 in greater detail. The exhaust deflector 30 includes a housing 60 (shown in FIG. 4) having a flange 65, a first wall 70, a second wall 75, and a collar 80. The flange 65 has an annular surface that is attached to the muffler flange 55 to define a substantially fluid tight seal therebetween. In preferred constructions, the flange 65 and the muffler flange 55 are planar to enhance the seal. Of course, non-planar arrangements are also possible. In some constructions a gasket, o-ring, or other sealing member 83 is positioned between the muffler flange 55 and the exhaust deflector flange 65 to enhance the seal between the two components. The flange 65 also includes a plurality of apertures 85 spaced around the flange 65 to receive fasteners. The fasteners pass through the flange 65 to attach the exhaust deflector 30 to the muffler 20.

The first wall 70 is a substantially cylindrical wall that extends a first non-zero distance 90 from the flange 65. In the illustrated construction, the first wall 70 is normal to the flange 65. However, other constructions may employ a different angle between the flange 65 and the first wall 70 as required for the particular application. In addition, while a cylindrical wall having a circular cross section has been illustrated, other constructions may employ other shapes. For example, an oval or elliptical cross section could be employed. In addition, polygonal cross section walls, or irregular shaped walls could also be employed if desired.

The second wall 75 extends from the first wall 70 and defines an outlet aperture 95. As illustrated, the second wall 75 is substantially normal to the first wall 70, and thus substantially parallel to the flange 65. In the illustrated construction, the second wall 75 defines a substantially planar surface, with other constructions employing non-planar second walls 75. The outlet aperture 95 includes a large opening approximately centered in the second wall 75. Of course, other constructions may employ multiple smaller apertures that cooperate to define the outlet aperture 95 and may include a second wall 75 that is not substantially normal to the first wall 70.

Figure 3:
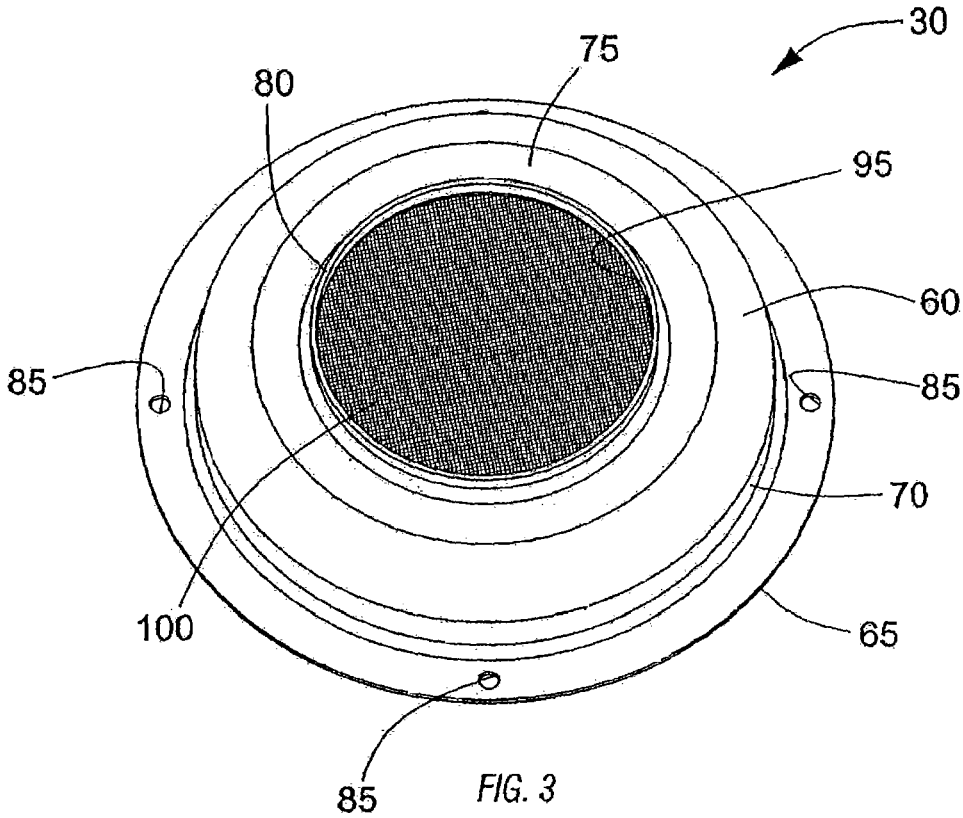
FIG. 3 is a front perspective view of the exhaust deflector of FIG. 2.
Figure 4:
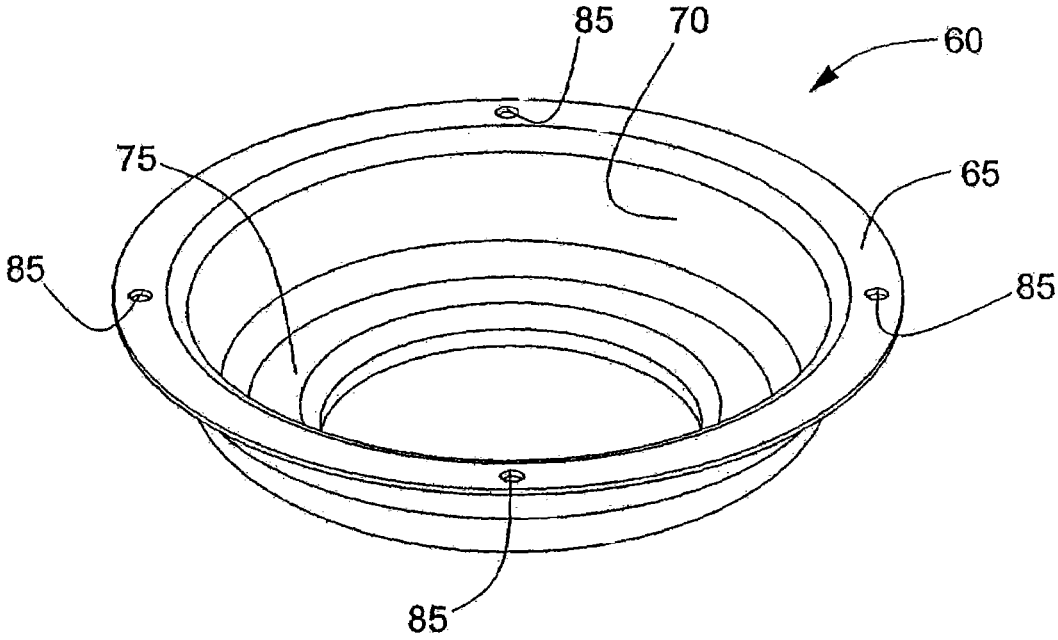
FIG. 4 is a rear perspective view of a housing of the exhaust deflector of FIG. 2.

The collar 80, shown in FIG. 3, encircles the outlet aperture 95 and extends from the second wall 75. The collar 80 is substantially normal to the second wall 75 and thus substantially parallel to the first wall 70. In some constructions, the collar 80 may be omitted or arranged at an angle other than one that is substantially normal to the second wall 75.

The housing 60 thus defines the inlet aperture and the outlet aperture 95. The inlet and the outlet aperture 95 cooperate to define a flow direction from the inlet aperture to the outlet aperture. This also defines an upstream direction and a downstream direction.

In preferred constructions, the housing 60 including the flange 65, the first wall 70, the second wall 75, and the collar 80 is integrally-formed as a single piece. For example, in one construction, the housing 60 is formed by stamping, drawing or otherwise forming a metal sheet. In other constructions, the housing 60 is cast or otherwise formed. In still other constructions, multiple separate pieces are attached to one another (e.g., welded, soldered, brazed, and the like) to complete the housing 60.

Figure 5:
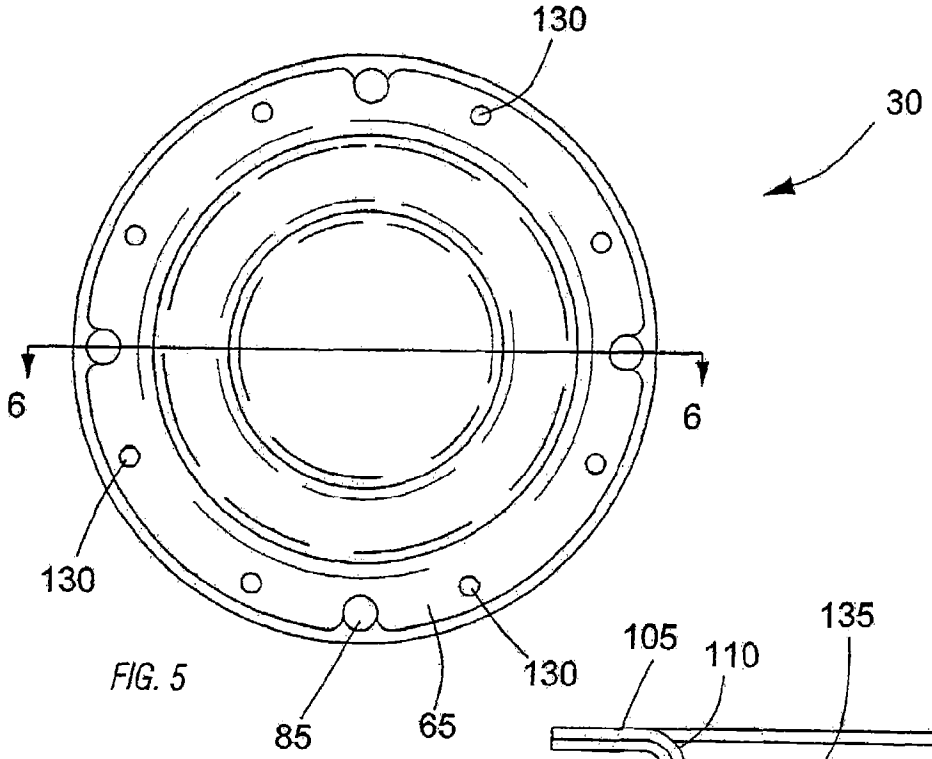
FIG. 5 is a rear view of the exhaust deflector of FIG. 2.
Figure 6:
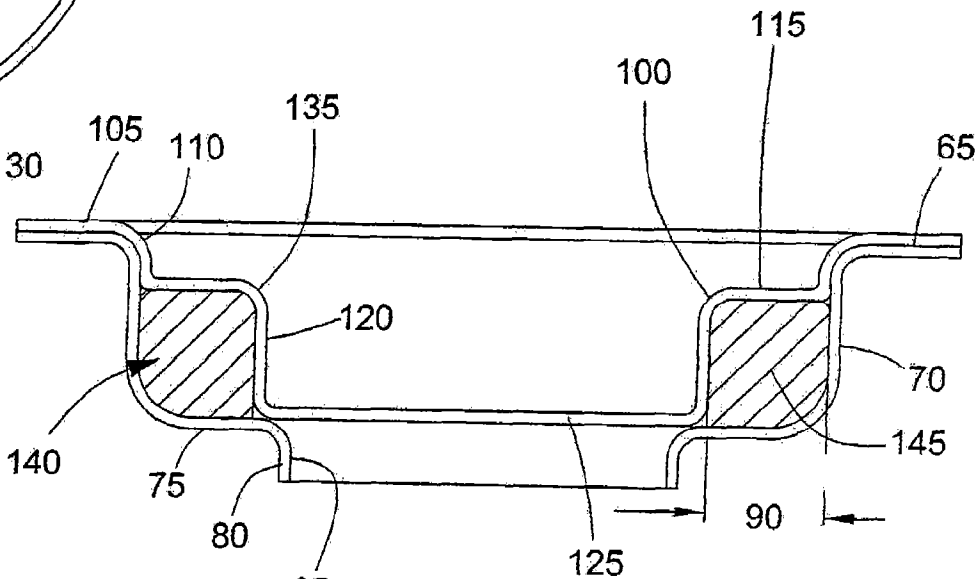
FIG. 6 is a section view of the exhaust deflector of FIG. 2, taken along line 6-6 of FIG. 5.

As illustrated in FIGS. 3, 5, and 6, the exhaust deflector 30 also includes a mesh 100 that attaches to the housing 60 and covers the outlet aperture 95. As illustrated in FIGS. 5 and 6, the mesh 100 attaches to the flange 65 and is contoured to define a flange portion 105, a first mesh wall 110, a second mesh wall 115, a third mesh wall 120, and an aperture-covering portion 125. The flange portion 105 is arranged to be parallel to the flange 65 to facilitate attachment of the mesh 100 to the flange 65. As illustrated in FIG. 5, a plurality of welds 130 can be employed to attach the mesh 100, with other attachment methods (e.g., fasteners, adhesives, clamps, soldering, brazing, and the like) also being suitable for use. In still other constructions, an interference fit between the mesh 100 and the housing 60 is sufficient to hold the mesh 100 in place.

Turning to FIG. 6, the first mesh wall 110 extends from the flange portion 105 such that it is parallel to and adjacent the housing first wall 70. However, the first mesh wall 110 extends along only a portion of the length of the first wall 70.

The second mesh wall 115 extends from the first mesh wall 110 and is substantially parallel to the flange 65. The second mesh wall 115 extends inward from the first mesh wall 110 to define an annular surface that includes an aperture 135 that is slightly larger than the outlet aperture 95. Of course many variations of this arrangement are possible. For example, the aperture 135 could be larger or smaller than that illustrated. In addition, the second mesh wall 115 could be arranged with respect to the first mesh wall 110 to define a non-normal angle.

The third mesh wall 120 extends from the second mesh wall 115 to the housing second wall 75. In the illustrated construction, the third mesh wall 120 is substantially parallel to the housing first wall 70 and is spaced apart from the housing first wall 70. Again, other arrangements and angles of the third mesh wall 120 are possible.

The third mesh wall 120 is substantially cylindrical and extends from the second mesh wall 115 to the outlet aperture 95. The aperture-covering portion 125 extends across the circular opening defined by the third mesh wall 120 adjacent the outlet aperture 95 to cover the aperture 95.

In preferred constructions, a single piece of mesh material 100 is used. Again, the mesh material 100 could be formed using a number of manufacturing techniques including stamping, drawing, progressive dies, and the like. Generally, a mesh 100 having a plurality of openings with opening sizes of about 0.023 inches (0.58 mm) or less for each opening is preferred (e.g., at least one of the length and width of a rectangular opening is less than or equal to about 0.023 inches). To verify that at least one of the openings include a dimension less than about 0.023 inches (0.58 mm), a pin test is often performed. The pin test employs a pin having a diameter of 0.024 inches (0.61 mm). If the pin cannot be passed through any of the openings, the openings are smaller than the largest desirable size. This also reduces the likelihood that particles equal to or larger than the pin cannot pass through the openings without damaging the mesh 100. However, meshes including larger average opening areas or smaller average opening areas are also possible.

With reference to FIG. 6, the mesh 100 and the housing 60 cooperate to define a space 140. More particularly, the second mesh wall 115 and the third mesh wall 120 cooperate with the first wall 70 and the second wall 75 of the housing 60 to define the space 140. The space 140 is substantially annular and has a substantially rectangular cross section. In most constructions, a low-density material 145 such as fiberglass is positioned within the space 140 to attenuate noise. Of course, low-density material 145 other than fiberglass could be employed so long as the material 145 is suited to exposure to high temperature fluids, high-flow velocity fluids, and/or the particular fluids that pass through the exhaust deflector 30.

Figure 7:
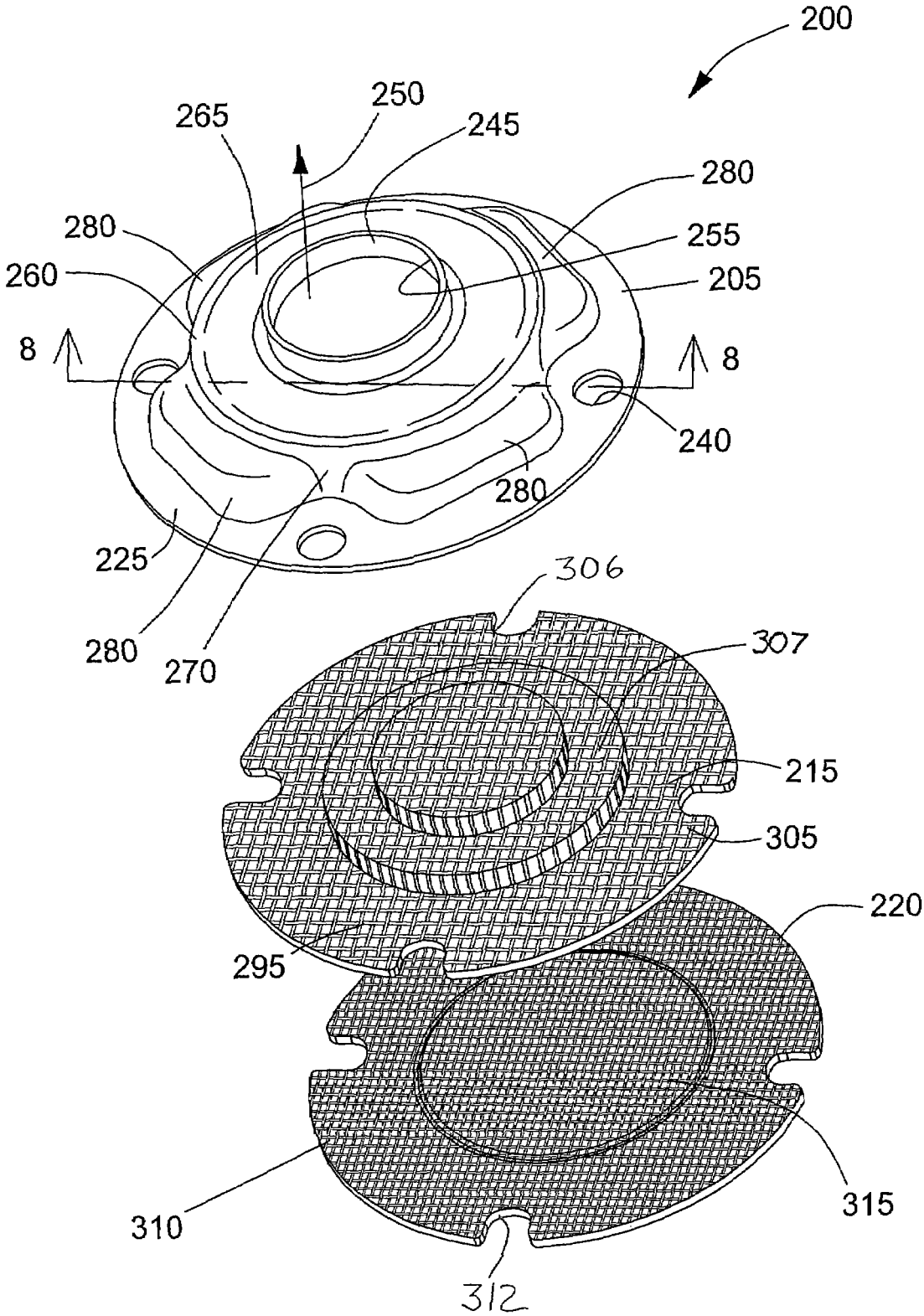
FIG. 7 is an exploded view of another exhaust deflector.
Figure 8:
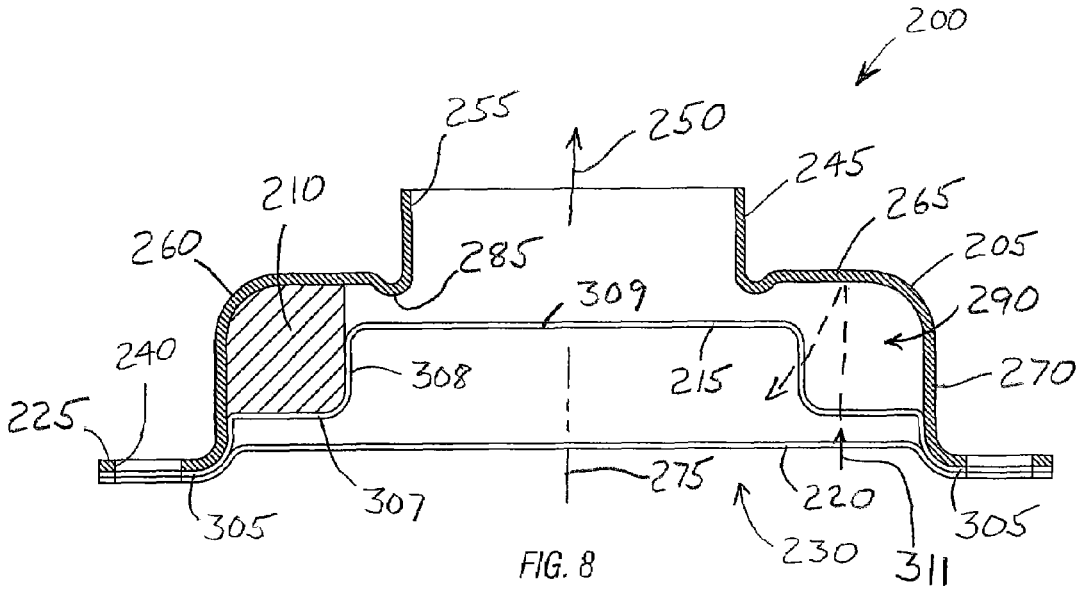
FIG. 8 is a section view of the exhaust deflector of FIG. 7 taken along line 8-8 of FIG. 7.

FIGS. 7 and 8 illustrate another arrangement of an exhaust deflector 200 that includes a housing 205, an optional low-density material 210, a perforated member 215 (sometimes referred to herein as a mesh), and a mesh or screen 220. The housing 205 is preferably integrally-formed as a single piece. However, some constructions may employ multiple pieces that are welded or otherwise attached to one another.

The housing 205 includes a flange 225 that preferably defines a substantially planar surface and an inlet 230 to the housing 205. The substantially planar surface is formed to engage another flange or surface to facilitate the attachment of the exhaust deflector 200 to a pipe, muffler, or other device. The illustrated construction includes four holes 240 that extend through the flange 225 and that are sized to receive bolts, screws, studs, or other fasteners to facilitate the attachment of the exhaust deflector 200. The bolt holes 240 can also serve to align the various components as desired.

A first or outlet wall 245 extends substantially parallel to a direction of gas flow 250 through the exhaust deflector 200 and defines an outlet 255. While a cylindrical outlet wall 245 is illustrated, other constructions could vary the shape of the outlet wall 245 as desired.

A second or intermediate wall 260 interconnects the first wall 245 and the flange 225 to complete the housing 205. The intermediate wall 260 includes a first portion 265 that extends radially outward from the first wall 245 to define a substantially planar surface, and a second portion 270 that extends substantially in the direction of flow 250 to connect the first portion 265 and the flange 225.

Portions of the second portion 270 extend outward, away from a central axis 275 of the exhaust deflector 200 to define protrusions 280. Generally, the protrusions 280 extend into the spaces between bolt holes 240 to provide for additional space or volume within the housing 205. Thus, the area within the housing 205 of a section that passes through the holes 240 of the exhaust deflector 200 is smaller than the area within the housing 205 of a section that passes through the protrusions 280 of the exhaust deflector 200 between two holes 240.

The first wall 245 cooperates with the first portion 265 of the second wall 260 to define an annular ridge 285 that extends around the outlet wall 245. It should be noted that some constructions might employ a partial or intermittent annular ridge 285 rather than the complete annular ridge 285 that is illustrated. In still other constructions tabs, protrusions or other retaining members extend from the first portion 265 as may be required.

The perforated member 215 is a substantially rigid component that includes a plurality of perforations 295. The perforations 295 are sized to allow for the passage of a gas, while also retaining the low-density material 210 if employed, as will be discussed.

The perforated member 215 includes a first substantially planar portion 305 that contacts the flange portion of the housing 205. The planar portion 305 includes a plurality of slots 306 that are sized and positioned to receive the fastener such that the same fastener that attaches the housing 205 to the muffler also attaches the perforated member 215. The perforated member 215 also includes a second substantially planar portion 307 and an axially-extending portion 308 that cooperate with the housing 205 to at least partially enclose the interior space 290. A third planar portion 309 extends across one end of the axially-extending portion to complete the perforated member 215.

In the construction illustrated in FIG. 8, the axially-extending portion 308 is sized such that the third planar portion 309 is spaced from the annular ridge 285. Thus, the space 290 that holds the low-density material 210 is not completely enclosed. In another construction, illustrated in FIG. 9, the axially-extending portion 308 is sized such that the third planar portion 309 contacts the annular ridge 285 and the space 290 that contains the low-density material 210 is completely or substantially enclosed by the housing 205 and the perforated member 215.

Figure 9:
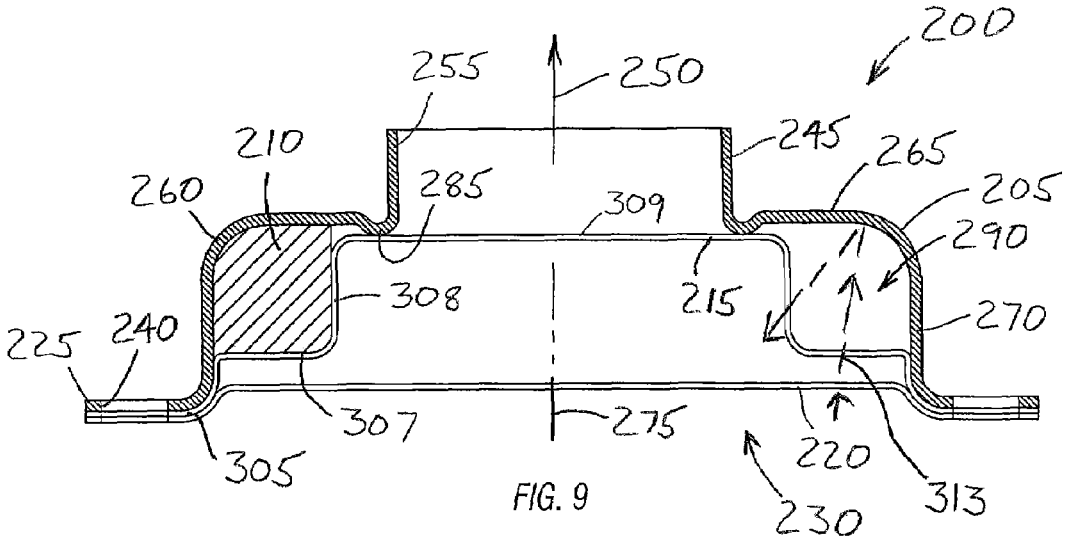
FIG. 9 is a section view of another exhaust deflector similar to the exhaust deflector of FIG. 7.

In preferred constructions, the low-density material 210 is disposed in the space 290 between the perforated member 215 and the housing 205. The low-density material 210 is preferably fiberglass but could include other materials as may be required by the particular application. In other constructions, no low-density material 210 is employed. FIGS. 8 and 9 illustrate the placement of low density material 210 in the left side space 290, while the right side space 290 is illustrated as not including any low-density material 210. This is done for illustration purposes only; in actual use, the low density material 210 would either be disposed in the entire circumference of annular space 290, or it would be absent from annular space 290.

The optional mesh or screen 220 preferably includes mesh apertures 310 that are smaller than the perforations 295. However, a perforated member 215 could be used in place of the mesh 220, and/or the mesh apertures 310 could be similar in size to, or larger than the perforations 295. In preferred constructions, the mesh apertures 310 are sized to inhibit the passage of particles in excess of 0.023 inches (0.58 mm). The mesh 220 is sized to substantially match the size and shape of the flange 225. In some constructions, the mesh 220 is welded or otherwise attached to the flange 225. In the illustrated construction, the mesh 220 includes four slots 312 sized and arranged to receive the same fasteners that attach the housing 205 and the perforated member 215 to the muffler.

Other constructions simply sandwich the mesh 220 between the flange 225 and the component to which the housing 205 attaches. The mesh 220 includes a circular recess portion 315 that extends into the housing 205 such that the mesh 220 is not a substantially planar component. However, some constructions could employ a planar mesh if desired.

The constructions of FIGS. 7, 8, and 9 operate in much the same way as the constructions of FIGS. 1-6. However, the inlet area of the mesh 220 of FIGS. 7-9 is larger than the inlet area of FIGS. 1-6. Additionally, the construction of FIGS. 7-9 provides for a larger volume of low-density material 210, thereby enhancing the sound dampening properties of the exhaust deflector 200 at some frequencies.

During engine operation, hot exhaust gas passes from the cylinder to the muffler inlet 45, through the muffler chamber, to the outlet 40. The muffler chamber reduces the magnitude of the noise produced by the engine 15. From the muffler outlet 40, the air enters the exhaust deflector 30, 200. The arrangement of the apertures that define the outlet 40 is such that a large portion of the exiting gas flows in a substantially straight line directly toward and into the space 290 and the low-density material 210, if employed.

As the exhaust gas passes into the exhaust deflector 30, 200, the mesh 220 blocks or arrests any sparks that may be traveling in the exhaust stream. In addition, the screen 220 slows the flow slightly and attenuates some of the noise of the flow. A substantial portion of the flow continues through the mesh 220 to the perforated member 215. Passage through the perforated member 215 again attenuates some of the sound. In constructions that employ low-density material 210 within the space 290, the material 210 deflects the gas through the perforated member 215 and out of the housing 205. While the gas is deflected, the sound waves produced by the flow tend to travel into the low-density material 210 and are attenuated. The second passage through the perforated member 215 again reduces the noise produced by the flow exiting the engine.

Constructions that do not employ the low-density material 210 are able to provide similar sound attenuation to constructions that do employ the low-density material 210. If no low-density material is used, a substantial portion of the exhaust gas still passes through the mesh 220 once and through the perforated member 215 twice before exiting the deflector housing 205, as shown by arrows 311 and 313 in FIGS. 8 and 9 respectively.

Sound pressure waves are dissipated as they freely pass though the mesh 100, 220, and the perforated member 215 in the construction of FIGS. 7-9, and pass into the low-density material 145, 210. Additionally, the properties of the mesh 100, 220, the housing 60, 205, and the perforated member 215 contribute to noise reduction and to spark arresting. Thus, the exhaust deflector 30, 200 changes the acoustic impedance and further reduces the noise produced by the engine 15. Generally, the arrangements described herein reduce the most unpleasant, high frequency noise while producing little loss in engine power. In some constructions, the reduction in engine noise is 3 dBA or greater.

The arrangement of the mesh 100, 220 is such that any forces produced by the flow of exhaust gas through the exhaust deflector 30, 200 tend to hold the mesh 100, 220 in the desired position. As such, additional support for the mesh 100, 220, or attachment points for the mesh 100, 220 are generally unnecessary.

The annular ridge 285 is sized to receive and at least partially retain the perforated member 215 in its desired operating position as shown in FIG. 9. When in this position, the perforated member 215 and the housing 205 cooperate to fully surround or enclose the space 290.

Thus, the invention provides, among other things, a new and useful exhaust deflector 30, 200 for a muffler 20. More specifically, the invention provides an exhaust deflector 30, 200 that further reduces the noise and sparks produced by an internal combustion engine 15.

What is claimed is:

1. An exhaust deflector configured to be coupled to a muffler, the exhaust deflector comprising:

a single-piece housing having an inlet aperture, a flange configured to be coupled to the muffler, an outlet defined by an outlet wall, and an intermediate wall between the flange and the outlet wall;

a mesh adjacent the flange and positioned to cover the inlet aperture;

a single piece perforated member that covers the outlet and is sandwiched between the mesh and the intermediate wall such that the perforated member and the intermediate wall cooperate to define a space; and a low-density material disposed within the space, wherein the intermediate wall includes a plurality of protrusions that increase the section area of the space with respect to sections that do not include the protrusion.

2. The exhaust deflector of claim 1, wherein the space is substantially annular.

3. The exhaust deflector of claim 1, wherein the mesh includes a plurality of openings, and wherein the size of the openings is less than about 0.024 inches.

4. The exhaust deflector of claim 1, wherein a portion of the mesh is sandwiched between the flange and the muffler.

5. The exhaust deflector of claim 1, wherein the mesh is welded to the flange.

6. The exhaust deflector of claim 1, wherein the low density material includes fiberglass.

7. The exhaust deflector of claim 1, wherein the perforated member includes a plurality of perforations and the mesh includes a plurality of mesh openings, and wherein the perforations are larger than the mesh openings.

8. An exhaust deflector configured to be coupled to a muffler, the exhaust deflector comprising:

a single-piece housing having an inlet aperture, a flange configured to be coupled to the muffler, an outlet defined by an outlet wall, and an intermediate wall between the flange and the outlet wall;

a mesh adjacent the flange and positioned to cover the inlet aperture;

a single piece perforated member that covers the outlet and is sandwiched between the mesh and the intermediate wall such that the perforated member and the intermediate wall cooperate to define a space; and a low-density material disposed within the space, wherein the outlet wall and the intermediate wall cooperate to define an annular ridge, and wherein the perforated member engages the annular ridge.

9. The exhaust deflector of claim 1, wherein the perforated member has a curved shape.

10. The exhaust defector of claim 1, wherein the intermediate wall extends from the first wall at an oblique angle.

11. An exhaust deflector configured to be coupled to a muffler, the exhaust deflector comprising:

a housing having a flange configured to be attached to the muffler, and an outer wall that extends from the flange and defines an inlet aperture; and a first mesh cooperating with the housing to at least partially define an annular space; and a second mesh that sandwiches the first mesh against the flange, wherein the housing defines an annular ridge, and wherein the first mesh engages the annular ridge.

12. The exhaust deflector of claim 11, further comprising a low-density material disposed in the space.

13. The exhaust deflector of claim 12, wherein the low-density material includes fiberglass.

14. The exhaust deflector of claim 11, wherein the first mesh includes a plurality of openings, and wherein at least one of the length and the width of the openings is less than about 0.024 inches.

15. The exhaust deflector of claim 11, wherein a portion of the first mesh is sandwiched between the flange and the muffler.

16. The exhaust deflector of claim 11, wherein the first mesh is welded to the flange.

17. An exhaust deflector configured to be coupled to a muffler, the exhaust deflector comprising:

a housing having a flange configured to be attached to the muffler, and an outer wall that extends from the flange and defines an inlet aperture; and a first mesh cooperating with the housing to at least partially define an annular space; and a second mesh that sandwiches the first mesh against the flange, wherein the housing includes a plurality of protrusions that increase the section area of the space with respect to sections that do not include the protrusion.

18. The exhaust deflector of claim 11, wherein the first mesh includes a plurality of perforations and the second mesh includes a plurality of mesh openings, and wherein the perforations are larger than the mesh openings.

19. The exhaust deflector of claim 11, wherein a flow passes through the housing in a flow direction and the annular ridge extends in a direction substantially opposite the flow direction.

20. The exhaust deflector of claim 11, wherein the annular ridge is positioned immediately adjacent the outlet such that the annular ridge defines a diameter about equal to an outlet diameter.

21. The exhaust deflector of claim 8, wherein a flow passes through the housing in a flow direction and the annular ridge extends in a direction substantially opposite the flow direction.

22. The exhaust deflector of claim 8, wherein the annular ridge is positioned immediately adjacent the outlet such that the annular ridge defines a diameter about equal to an outlet diameter.

* * * * *